United States Patent [19]

Hiraga

[11] Patent Number: 4,498,852

[45] Date of Patent: Feb. 12, 1985

[54] SCROLL TYPE FLUID DISPLACEMENT APPARATUS WITH IMPROVED END PLATE FLUID PASSAGE MEANS

[75] Inventor: Masaharu Hiraga, Honjo, Japan

[73] Assignee: Sanden Corporation, Japan

[21] Appl. No.: 356,497

[22] Filed: Mar. 9, 1982

[30] Foreign Application Priority Data

Mar. 9, 1981 [JP] Japan ..... 56-33645

[51] Int. Cl.[3] ..... F01C 1/02; F01C 19/08

[52] U.S. Cl. ..... 418/55; 418/142; 418/178

[58] Field of Search ..... 418/55, 59, 142, 178

[56] References Cited

U.S. PATENT DOCUMENTS

| | | | |
|---|---|---|---|
| 904,209 | 11/1908 | Lyons et al. | 418/59 |
| 3,313,239 | 4/1967 | Brunson et al. | 418/178 |
| 3,874,827 | 4/1975 | Young | 418/55 |
| 4,160,629 | 7/1979 | Hidden et al. | 418/55 |

*Primary Examiner*—John J. Vrablik

*Attorney, Agent, or Firm*—Banner, Birch, McKie & Beckett

[57] ABSTRACT

A scroll type fluid displacement apparatus having a pair of interfitting, relatively orbiting scroll members which define a plurality of moving fluid pockets. A fluid passage through the end plate of one of the scroll members has an elongated shape to reduce contact of the axial end of the other scroll member with the edge of the fluid passage, thereby reducing wear and improving volumetric efficiency.

18 Claims, 13 Drawing Figures

SCROLL TYPE FLUID DISPLACEMENT APPARATUS WITH IMPROVED END PLATE FLUID PASSAGE MEANS

BACKGROUND OF THE INVENTION

This invention relates to a fluid displacement apparatus, and more particularly, to a fluid displacement apparatus of the scroll type.

Scroll type fluid displacement apparatus are well known in the prior art. For example, U.S. Pat. No. 801,182 discloses a device including two scroll members each having a circular end plate and a spiroidal or involute spiral element. These scroll members are maintained angularly and radially offset so that both spiral elements interfit to make a plurality of line contacts between their spiral curved surfaces, thereby sealing off and defining at least one pair of fluid pockets. Relative orbital motion of the two scroll members is effected by a rotating crank mechanism. This motion shifts the line contacts along the spiral curved surfaces and, therefore, the fluid pockets change in volume. The volume of the fluid pockets increases or decreases depending on the direction of the orbital motion. Therefore, the scroll type fluid apparatus is applicable to compress, expand, or pump fluids.

In these scroll type fluid displacement apparatus, compression, expansion or pumping of the fluid is achieved by the change of volume of the fluid pockets defined between the spiral elements. The fluid pockets are defined by the line contacts between interfitting spiral elements, and the axial contacts between the axial end surface of each spiral element and the inner end surface of the end plate of the opposing scroll member. As the orbiting scroll member orbits, the line contacts shift along the spiral curved surfaces of the spiral elements, and the axial contacts slide on the inner end surface of each end plate. Effective sealing of the fluid pockets in these moving areas of contact is essential for efficient operation of the apparatus.

Various techniques have been used in the prior art to resolve the sealing problem, in particular, that relating to axial sealing. In U.S. Pat. No. 3,994,636, incorporated herein by reference, a seal element is mounted in a groove in the axial end surface of each spiral element. An axial force urging means in each groove, such as spring, urges the seal element toward the facing end surface of the end plate, thereby effecting an axial seal.

Because the seal element disclosed in the above patent is urged toward the facing end surface of the end plate by a spring or other axial force urging mechanism, over period of time, wear occurs between the end surface of the seal element and the end plate of the scroll member, especially when a light weight alloy, such as an aluminum alloy, is used as a material for the scroll member.

One solution to these problems is disclosed in commonly assigned copending application Ser. No. 312,755, filed Oct. 9, 1981, and incorporated herein by reference. This application discloses an involute anti-wear plate disposed between the axial end surface of a spiral element and the inner end surface of the opposite end plate. The involute anti-wear plate covers the area of the surface of the end plate where the other spiral element makes axial contact during orbital motion. Excessive wear or abrasion of the end plate is thereby prevented.

In this arrangement, shown in FIGS. 1–3, the end plate 2 of one scroll member is formed with a hole 3 at its center portion for passage of the fluid. The hole 3 is generally formed by a simple and low-cost drilling or end milling operation, so that the hole is circular and is formed near the inner end portion of spiral element 6 adjacent its inner wall, as shown in FIG. 1. Involute plate 4 disposed on the end plate 2 must be formed with matching hole 5 which is aligned with the hole 3 of end plate 2. During relative orbital movement of the scroll members, the inner end portion of spiral element 6' sweeps over hole 3 (see FIG. 2). If seal element 7 extends nearly to the inner end of spiral element 6'—a design which affords optimum sealing—seal element 7 will be quickly worn by abrasion against the edge of hole 3. Sealing is therefore usually compromised for the sake of seal longevity by using a seal element which terminates well short of the inner end of spiral element 6'.

As described in the aforesaid copending application Ser. No. 312,755, relative orbital movement of the scroll members diminishes the size of intermediate fluid pockets 8, 8' (FIG. 2) until the line contacts near the inner ends of spiral elements 6, 6' are broken. At this point the central high pressure fluid space or pocket communicates with intermediate fluid pockets 8, 8', causing a back flow of high pressure fluid into pockets 8, 8'. This results in an increase of the re-expansion volume, and a consequent loss of volumetric efficiency. This phenomenon is inherent in the operation of a scroll type compressor, but its undesirable effects can be minimized by efficient design. Volumetric efficiency can be maximized by delaying as much as possible communication of the central high pressure fluid space with the intermediate fluid pockets 8, 8', i.e., by maximizing the crank angle at which this communication occurs. Communication of the central high pressure fluid space with fluid pockets 8, 8' also can occur when the inner end portion of spiral element 6' is completely over hole 3, allowing high pressure fluid to leak back into pocket 8 behind the outer surface **6*a* of spiral element 6'. This can occur before the line contacts near the inner ends of spiral elements 6, 6'** are broken.

In a compressor, hole 3 is generally larger than it would be in other types of scroll apparatus. Spiral element 6' therefore encounters hole 3 earlier (i.e., at a smaller crank angle) than it would a smaller hole. Hence, leakage of high pressure fluid behind surface **6*a* of spiral element 6'** occurs earlier than desired, resulting in a premature increase in the re-expansion volume and a loss of volumetric efficiency.

Referring to FIGS. 2 and 11, the compression cycle of fluid in one fluid pocket will be described. FIG. 11 shows the relationship in a scroll type compressor of fluid pressure in an intermediate fluid pocket (8) to drive shaft crank angle, and shows that one compression cycle is completed in this case at a crank angle of $4\pi$. The compression cycle begins with the outer end of each spiral element 6, 6' in contact with the opposite spiral element, the suction stroke having finished. The state of fluid pressure in the fluid pockets in shown at point A in FIG. 11. The volume of the fluid pockets is reduced and fluid is compressed by the revolution of the orbiting scroll member until the crank angle reaches $2\pi$, which state is shown by point B in FIG. 11. In this ideal case, where the re-expansion volume is zero, the fluid pressure is consequently increased to the discharge pressure (which is a function of the resiliency of reed valve 9—FIG. 3) by revolution of the orbiting scroll member, as shown by curve B-C-E in FIG. 11.

Generally in a compressor, however, after passing point C in FIG. 11, the pressurized intermediate pair of fluid pockets 8, 8′ adjacent the central high pressure space are simultaneously connected to one another and to the high pressure space, which is located at the center of both spiral elements. As shown in FIG. 2, the high pressure space communicates to a discharge chamber through valve 9. At this time, the fluid pressure in the connected fluid pockets 8, 8′ rises slightly due to mixing of high pressure fluid with the fluid in the connecting fluid pockets. This state is shown at point D′ in FIG. 11. The fluid in the high pressure space is further compressed by revolution of the orbiting scroll member until it reaches the discharge pressure. This state is shown at point E′ in FIG. 11. When the fluid pressure in the high pressure space reaches the discharge pressure, the fluid is discharged to the discharge chamber. In this case, the pressure in the fluid pocket 8 rises at the midway point of the compression cycle, resulting in a compression power loss which is represented by the shaded area in FIG. 11 between curves CE and D′E′.

SUMMARY OF THE INVENTION

It is a primary object of this invention to provide an improvement in a scroll type fluid displacement apparatus of the type described having reduced re-expansion volume without increased compression power loss.

Another object of the invention is to provide such a scroll type fluid displacement apparatus wherein communication between fluid pockets is delayed to a maximum extent to minimize the increase in re-expansion volume and maximize volumetric efficiency.

Another object of the invention is to provide such a scroll type fluid displacement apparatus wherein axial seal life is prolonged.

Another object of this invention is to provide such a scroll type fluid displacement apparatus which is simple in construction, easily manufactured, and which achives the above described objects.

These and other objects of the invention are achieved by providing a scroll type fluid displacement apparatus of the character described, having fluid passage means through the end plate of one scroll member adjacent the inner end portion of the spiral wrap attached to the end plate, the fluid passage means having a generally elongated cross-section with the longer dimension thereof extending generally parallel to the adjacent portion of the spiral wrap. The fluid passage means may comprise a hole through the end plate and a notch in a mating involute anti-wear plate, the notch overlying the hole with the involute plate blocking a portion of the hole.

The invention also includes a scroll type fluid displacement apparatus of the character described, having a bore which extends through the end plate of one scroll member into the inner end portion of the spiral wrap which is attached to the end plate, the bore opening as a channel through the inner wall surface of the spiral wrap facing the center of the spiral wrap.

Further objects, features and other aspects of the invention will be understood from the following detailed description of a preferred embodiment of the invention referring to the annexed drawings.

DETAILED DESCRIPTION OF THE PREFERRED EMBODIMENT

Figure 1:
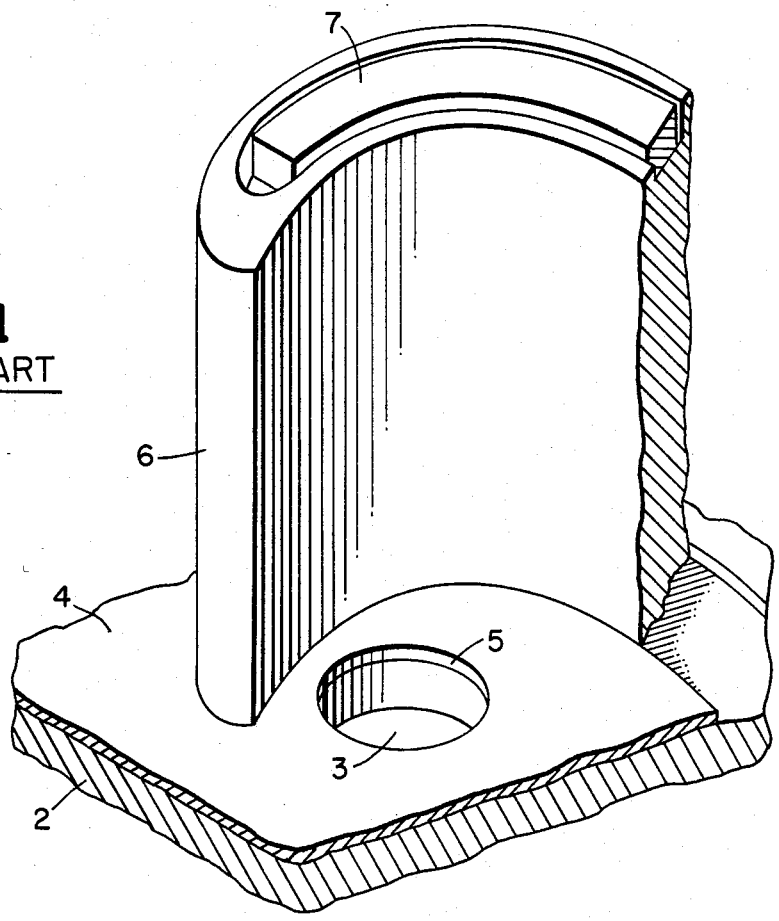
FIG. 1 PRIOR ART
FIG. 1 is a perspective view of the center portion of a prior art scroll member.
Figure 3:
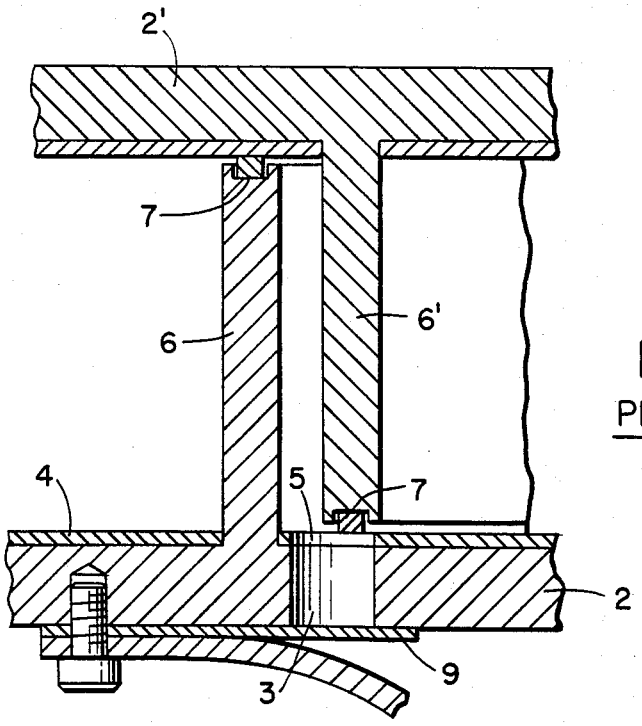
FIG. 3 PRIOR ART
FIG. 3 is a sectional view taken along line 3—3 in FIG. 2.
Figure 2:
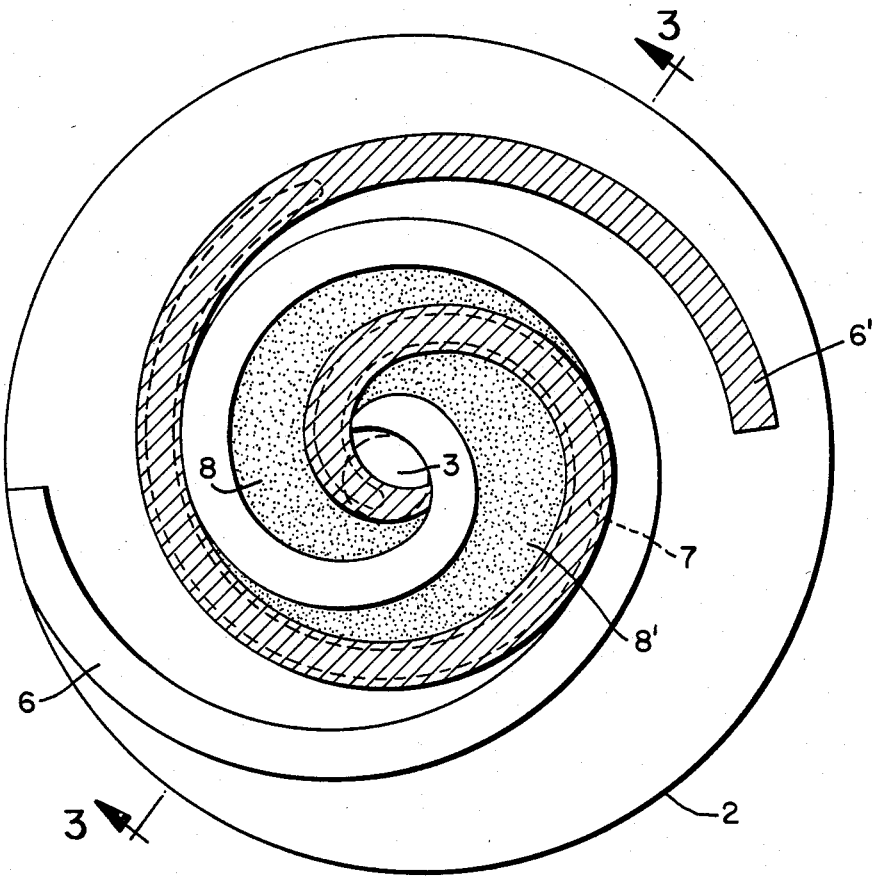
FIG. 2 PRIOR ART
FIG. 2 is a schematic view illustrating the interfitting relationship of prior art spiral elements.
Figure 4:
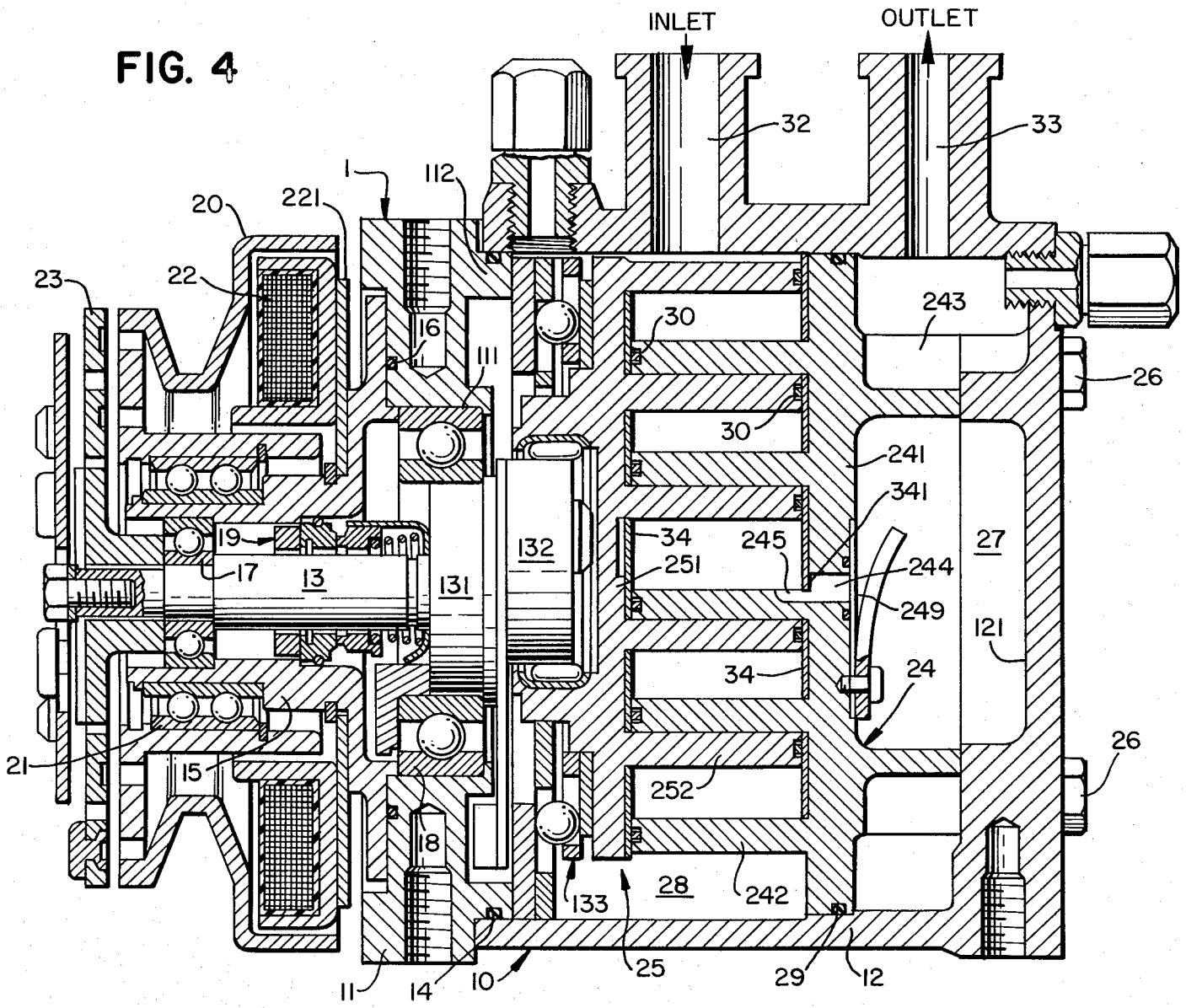
FIG. 4 is a vertical sectional view of a compressor of the scroll type according to the invention.

FIG. 4 illustrates a fluid displacement apparatus in accordance with the present invention, in particular a scroll type fluid displacement apparatus 1 according to one embodiment of the present invention. The apparatus 1 includes a housing 10 comprising a front end plate member 11 and a cup-shaped casing 12 which is disposed on an end surface of font end plate member 11. An opening 111 is formed in the center of front end plate member 11 for penetration or passage of a drive shaft 13. An annular projection 112 is formed on the rear end surface of front end plate member 11 which faces casing 12. An outer peripheral surface of annular projection 112 fits into an inner wall surface of the opening portion of casing 12. Casing 12 is fixed on the rear end surface of front end plate member 11 by a fastening means, for example bolts (not shown), so that the opening portion of casing 12 is covered by front end plate member 11. An O-ring member 14 is disposed between the outer peripheral surface of annular projection 112 and the inner wall surface of casing 12, to thereby effect a seal between the fitting or mating surfaces of front end plate member 11 and casing 12.

Front end plate member 11 has an annular sleeve portion 15 projecting from the front end surface thereof for surrounding drive shaft 13 to define a shaft seal cavity. In this embodiment, sleeve portion 15 is separate from front end plate member 11. Therefore, sleeve portion 15 is fixed to the front end surface of front end plate member 11 by a plurality of screws (not shown). An O-ring 16 is disposed between the end surface of front end plate member 11 and sleeve portion 15. Alternatively, sleeve portion 15 may be formed integral with front end plate member 11.

Drive shaft 13 is rotatably supported by sleeve portion 15 through a bearing 17 disposed within the front end portion of sleeve portion 15. Drive shaft 13 is formed with a disk portion 131 at its inner end portion.

and disk portion 131 is rotatably supported by front end plate member 11 through a bearing 18 disposed within opening 111 of front end plate member 11. A shaft seal assembly 19 is assembled on drive shaft 13 within the shaft seal cavity of sleeve portion 15.

A pulley 20 is rotatably supported by sleeve portion 15 through a bearing 21 which is disposed on the outer surface of sleeve portion 15. An electromagnetic coil 22 is fixed on the outer surface of sleeve portion 15 by a support plate 221 and is received in an annular cavity of pulley 20. An armature plate 23 is elastically supported on the outer end portion of drive shaft 13 which extends from sleeve portion 15. A magnetic clutch comprising pulley 20, magnetic coil 22, and armature plate 23 is thereby formed. Thus, drive shaft 13 is driven by an external power source, for example the engine of an automobile, through force transmitting means, such as the magnetic clutch.

A fixed scroll member 24, an orbiting scroll member 25, a crank-type driving mechanism 132 of orbiting scroll member 25, and a rotation preventing mechanism 133 of orbiting scroll member 25 are disposed in an inner chamber of cup-shaped casing 12. Typical driving and rotation preventing mechanisms are described in detail in the aforesaid copending application Ser. No. 312,755.

Fixed scroll member 24 includes a circular end plate 241, a wrap means or spiral element 242 affixed to and extending from one side surface of end plate 241, and a plurality of internally threaded bosses 243 axially projecting from the end surface of end plate 241 opposite to the side thereof from which spiral element 242 extends. The end surface of each boss 243 is seated on the inner surface of end plate portion 121 of cup-shaped casing 12 and is fixed to end plate portion 121 by bolts 26. Hence, fixed scroll member 24 is fixedly disposed within casing 12. Circular end plate 241 of fixed scroll member 24 partitions the inner chamber of casing 12 into a discharge chamber 27 and a suction chamber 28 by a seal ring 29 disposed between the outer peripheral surface of end plate 241 and the inner wall of casing 12.

Orbiting scroll member 25 is disposed within suction chamber 28 and also comprises a circular end plate 251 and a wrap means or spiral element 252 affixed to and extending from one side surface of end plate 251. Spiral element 252 and spiral element 242 of fixed scroll member 24 interfit at an angular offset of 180° and a predetermined radial offset. At least one pair of fluid pockets are thereby defined between spiral elements 242, 252. Orbiting scroll member 25 is connected to the driving mechanism and the rotation preventing mechanism. These two mechanisms effect orbital motion at a circular orbital radius Ro (not shown) by rotation of drive shaft 13, to thereby compress fluid passing through the compressor unit. Each spiral element 242, 252 is provided with a groove 30 formed in its axial end surface along the spiral curve. A seal element 31 is loosely fitted within groove 30. Sealing between the axial end surface of each spiral element and the inner end surface of the opposite end plate is effected by the seal element.

As above described, when orbiting scroll member 25 is allowed to undergo the orbital motion of radius Ro by the rotation of drive shaft 13, line contacts between both spiral elements 242, 252 shift along the spiral curved surfaces so that the fluid pockets move to the center of the spiral elements. Therefore, fluid or refrigerant gas, introduced into the suction chamber 28 from an external fluid circuit through an inlet port 32 on casing 12, is drawn into the fluid pockets formed between spiral elements 242, 252. As orbiting scroll member 25 orbits, fluid in the fluid pockets is moved to the center of the spiral elements with a consequent reduction of volume. Compressed fluid is discharged into discharge chamber 27 from the fluid pockets at the center of the spiral elements through a hole 244, which is formed through circular end plate 241 of fixed scroll member 24 at a position near the center of spiral element 242, past a valve 249, and is discharged therefrom through an outlet port 33 formed on casing 12 to an external fluid circuit, for example a cooling circuit.

Figure 5:
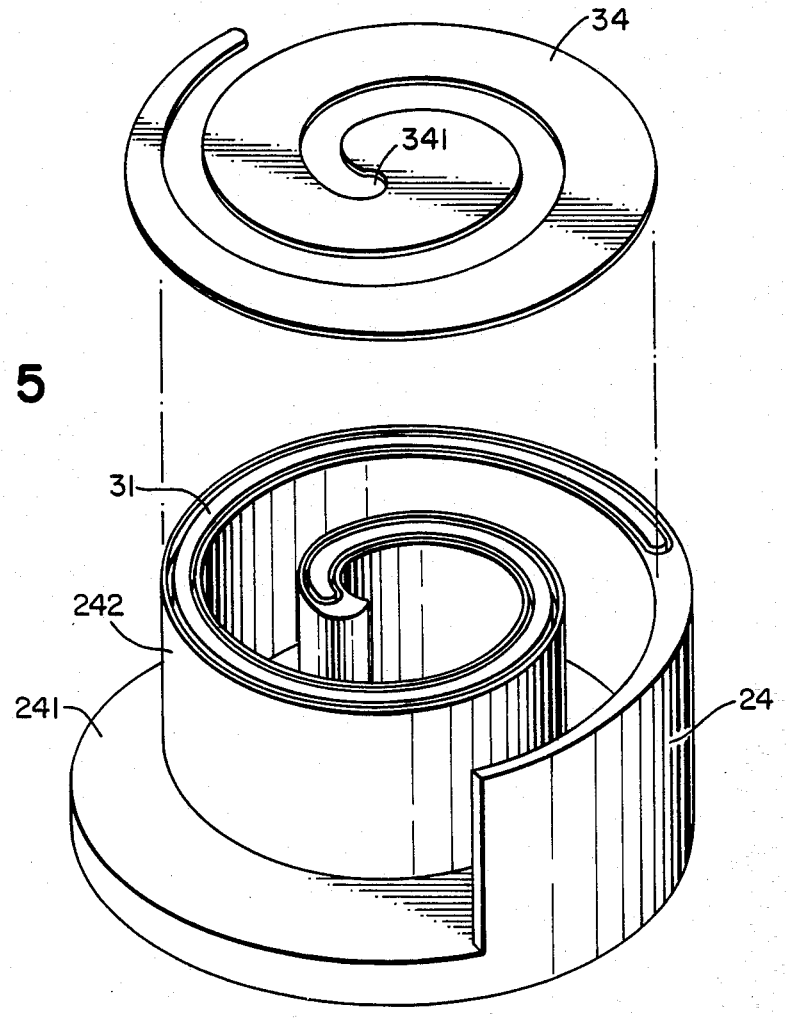
FIG. 5 is an exploded perspective view of the fixed scroll member used in the compressor of FIG. 4.

In this arrangement, seal element 31 which is disposed in the axial end surface of each spiral element slides on the inner end surface of the opposite end plate and is urged against the end plate by compressed fluid. An involute anti-wear plate 34 (FIG. 5) is disposed between the axial end surface of each spiral element 242, 252 and the inner end surface of the opposite end plate 241, 251 for preventing wear of the end plate. Involute anti-wear plates 34 cover the area of the surfaces of end plates 241, 251 where spiral elements 242, 252 make axial contact during the orbital motion. The involute anti-wear plate 34 which is disposed on end plate 241 of fixed scroll member 24 is formed with a connecting notch or portion 341 adjacent discharge hole 244 of fixed scroll member 24, as shown in FIG. 4.

Figure 6:
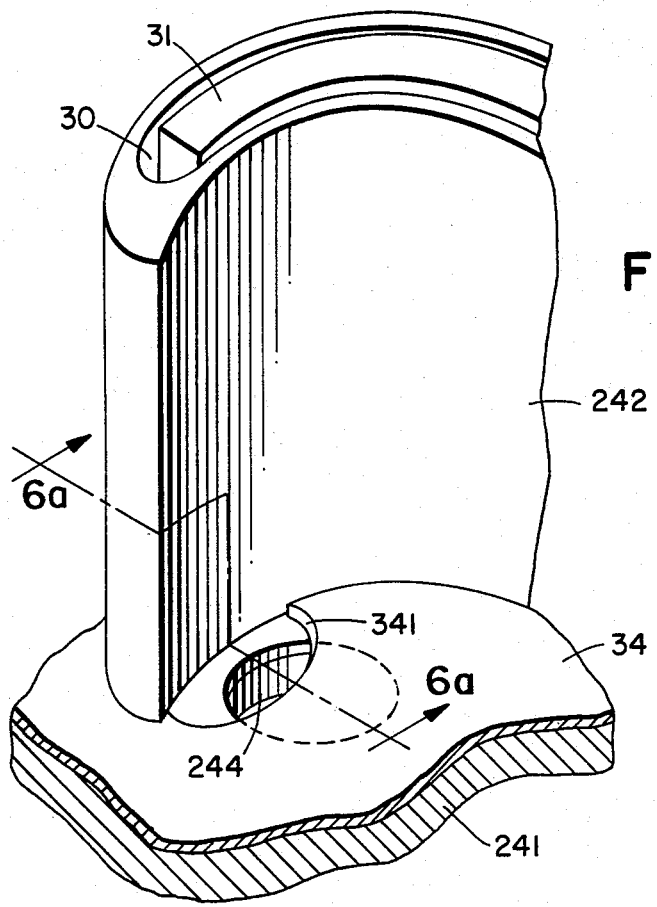
FIG. 6 is an enlarged perspective view of the center portion of the fixed scroll member used in the compressor of FIG. 4.
Figure 6B:
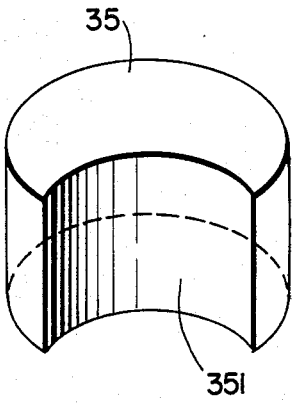
FIG. 6*b* is a perspective view of a plug used in a modified form of compressor.
Figure 6A:
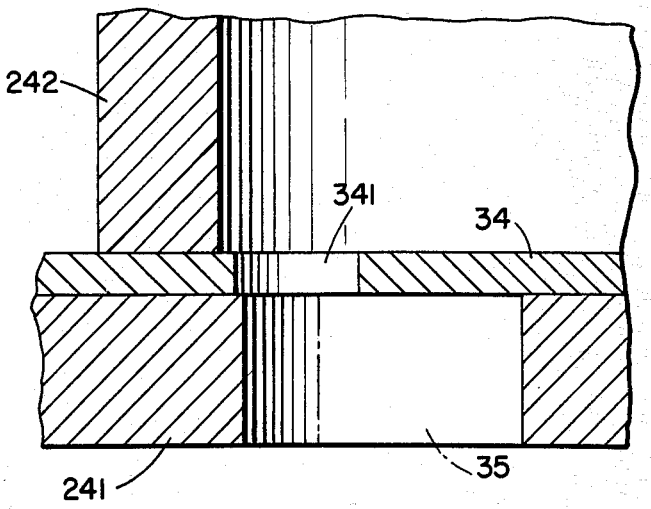
FIG. 6*a* is a sectional view taken along line 6*a*—6*a* in FIG. 6.
Figure 11:
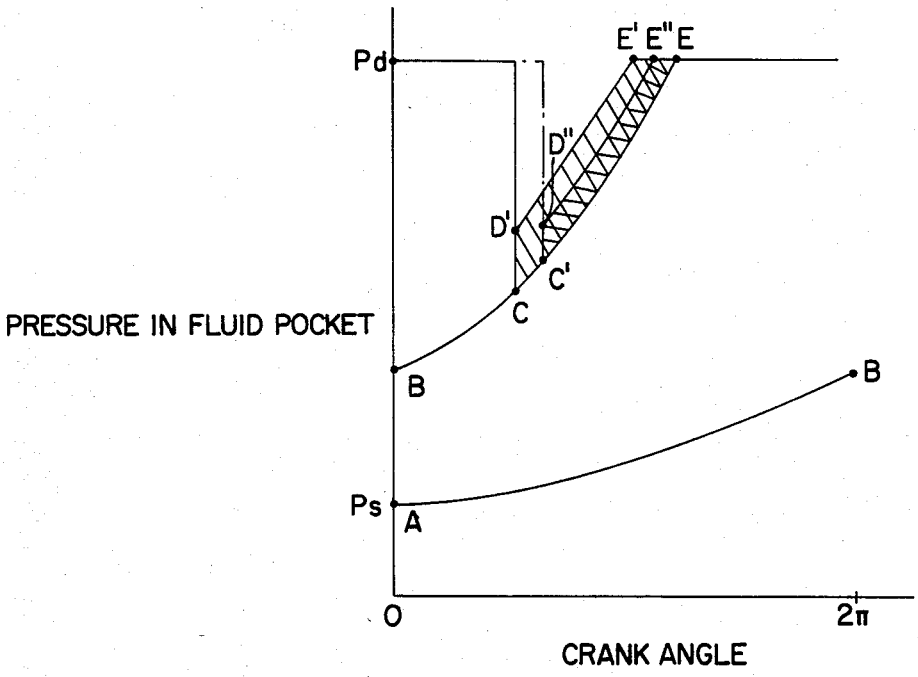
FIG. 11 is a pressure-crank angle diagram illustrating the compression cycle in each of the fluid pockets.

Referring to FIGS. 6 and 6*a*, a portion of hole 244 of fixed scroll member 24 is covered by part of involute plate 34, so that the open area of hole 244 is reduced and is moved closer to spiral element 242. Because of this, the area of the inner end portion of spiral element 252 which sweeps over hole 244 and contacts notch 341 of involute plate 34 is reduced. Therefore, seal element 31 disposed in spiral element 252 of orbiting scroll member 25 can extend closer to the inner end of spiral element 252, thereby improving axial sealing without premature seal wear. In addition, communication of the high pressure fluid pocket with the intermediate pressurized fluid pockets will be delayed, thereby reducing compression loss as shown by curve C′-D″-E″ in FIG. 11, and improving volumetric efficiency.

In order to further reduce the re-expansion volume and thereby improve volumetric efficiency, the portion of hole 244 which is located directly beneath the overlying portion of anti-wear plate 34 may be filled with a crescent-shaped plug 35 (FIG. 6*b*) whose curved face 351 is aligned with and matches the curved edge of notch 341. Plug 35 is preferably affixed in its proper position to the underside of anti-wear plate 34 so that, upon assembly of plate 34 with scroll member 24, plug 35 will be properly positioned and maintained in hole 244.

Figure 7:
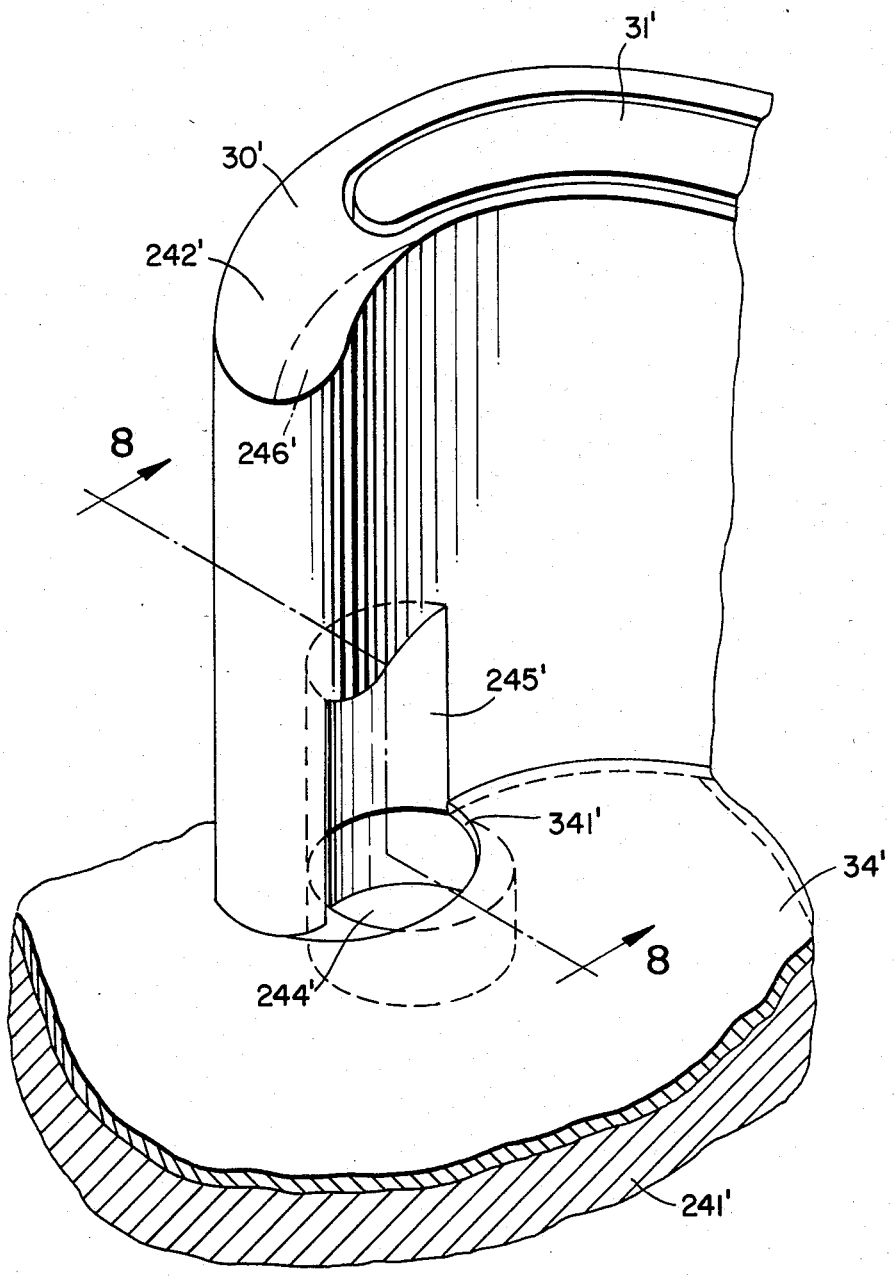
FIG. 7 is a perspective view of the center portion of the fixed scroll member according to another embodiment of this invention.
Figure 8:
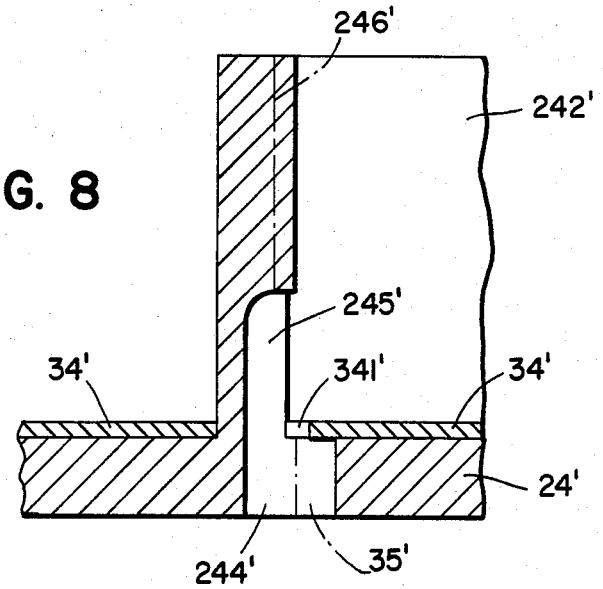
FIG. 8 is a sectional view of the center portion of the fixed scroll member taken along line 8—8 in FIG. 7.

FIGS. 7 and 8 show an alternative embodiment of the present invention, wherein the placement of the hole formed through the end plate of the fixed scroll member is altered. These figures are similar to FIGS. 6 and 6*a*, except that like elements are denoted by like primed numerals. In this arrangement, hole 244′ is drilled or bored in end plate 241′ of fixed scroll member 24′ partially beneath spiral element 242′. Hence, a part of the inner wall surface of fixed spiral element 242′ opens to a channel 245′ which interconnects the central fluid pocket and hole 244′ of fixed scroll member 24′. A part of hole 244′ is covered by involute anti-wear plate 34′, and plate 34′ has a connecting notch or portion 341′ located over hole 244′. Hence, the area of the inner end portion of spiral element 252′ which sweeps over hole 244 and contacts notch 341′ is reduced, similarly resulting in decreased seal wear, improved axial sealing, delayed backflow of high pressure fluid, and improved volumetric efficiency. It is also possible to reduce the reexpansion volume in this embodiment by installing a similar crescent-shaped plug 35′ in hole 244′ (see FIG. 8).

Figure 9:
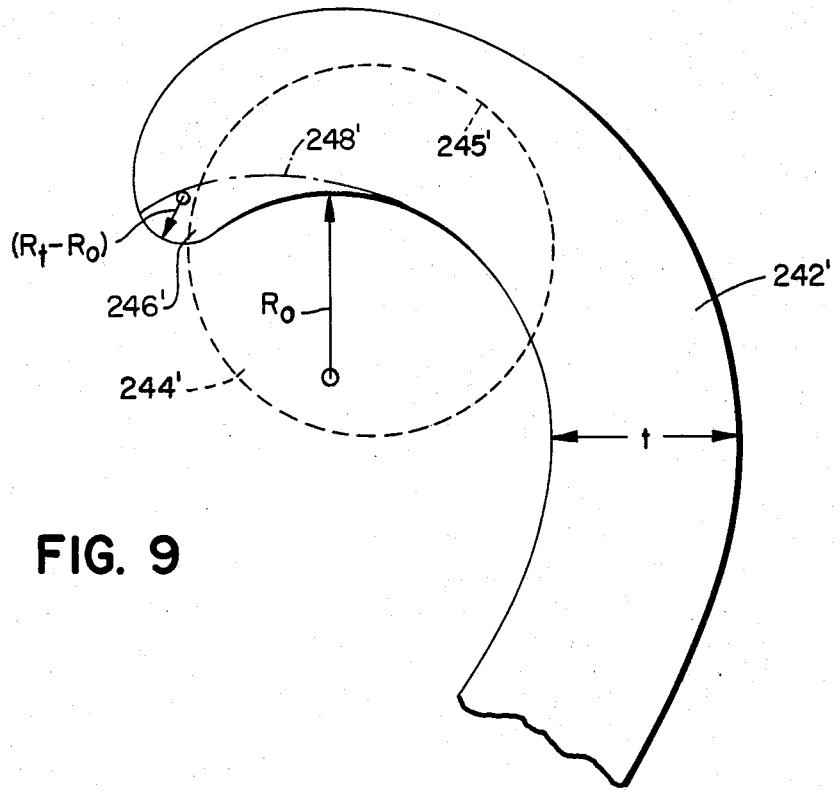
FIG. 9 is a schematic view illustrating the configuration of the inner end of a spiral element according to the embodiment of FIG. 7.
Figure 10:
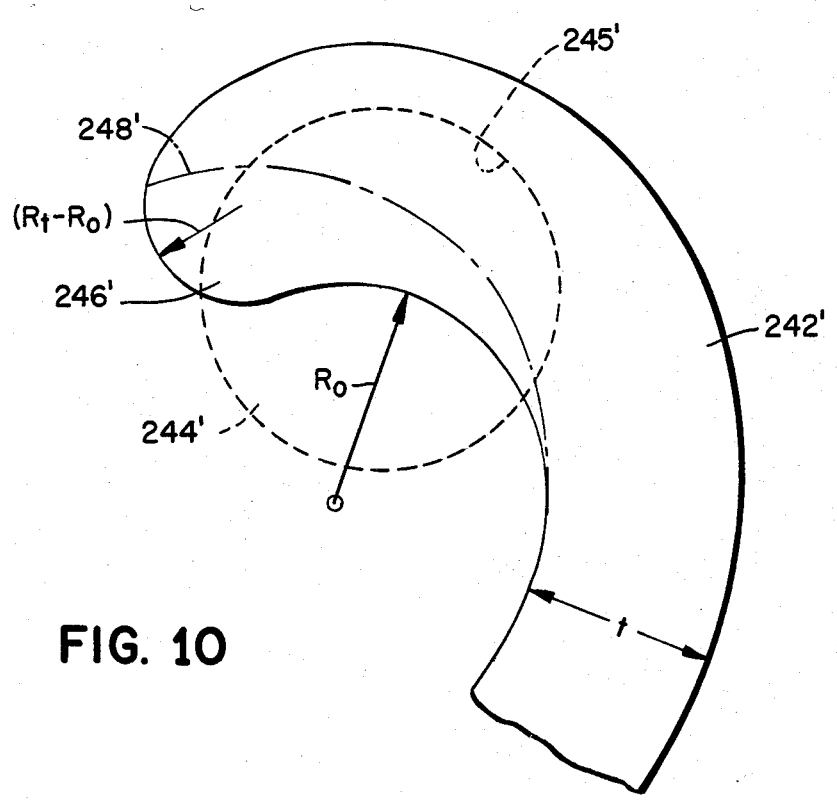
FIG. 10 is a schematic view illustrating another configuration of the inner end of a spiral element according to the embodiment of FIG. 7.

FIGS. 9 and 10 show two different configurations of the inner end portion of fixed spiral element 242′ of the embodiment of FIGS. 7 and 8. In each, the inner wall surface of fixed spiral element 242′ has a portion 246′ at the inner end portion thereof which protrudes inwardly beyond the normal involute spiral surface 248′. The curve of protruding portion 246′ is close to or actually coincides with the orbital envelope generated by the center portion of spiral element 252′ during its orbital motion. The protrusion 246′ reduces the re-expansion volume, thereby improving volumetric efficiency, and strengthens the spiral element 242′, which may be weakened somewhat by the formation of channel 245′ therein.

Referring to FIG. 9, spiral element 242′ having thickness t is formed by a numerically controlled milling machine. The radius $R_t$ of the working tool used for this machine is one half the pitch of the spiral element. The outer and inner wall surfaces of the spiral are, therefore, worked by this tool at the same time. The curve of protruding portion 246′ is defined by an arc of orbital radius $R_o$, which coincides with the orbital envelope generated by the orbiting scroll member, and by an arc having a radius $R_t$-$R_o$. In FIG. 10, the radius $R_t$ of the working tool is twice the radius of the involute generating circle. The curve of protruding portion 246′ is defined by an arc of orbital radius $R_o$, and an arc of radius $R_t$-$R_o$.

Although the present invention has been illustrated in terms of a preferred embodiment, it will be obvious to one of ordinary skill that numerous modifications may be made without departing from the true spirit and scope of the invention, which is to be limited only by the appended claims. For example, in the embodiment of FIGS. 6 and 6*a*, hole 244 need not be circular. Hole 244 is preferably circular because it is easy and relatively inexpensive to simply drill or bore a circular hole through end plate 241. Using more complicated fabrication techniques, however, it is possible to form hole 244 as a crescent-shaped hole which matches the contour of notch 341. Hole 244 and notch 341 would then be fully aligned. Similarly in the embodiment of FIGS. 7 and 8, hole 244′ could be formed as a crescent-shaped hole which would match the contour of notch 341′.

I claim:

1. In a scroll type fluid displacement apparatus including first and second scroll members having, respectively, first and second end plates and first and second spiral wraps extending from one side surface of said first and second end plates, said spiral wraps interfitting at an angular and radial offset to make a plurality of line contacts between their spiral curved surfaces and axial contacts between the axial end surfaces of said spiral wraps and the opposed end plates thereby to define a plurality of fluid pockets, driving means operatively connected to at least one of said scroll members to effect relative orbital motion of said scroll members while preventing relative rotation thereof thereby to cause said fluid pockets to move and change in volume, fluid passage means through said first end plate adjacent the inner end portion of said first spiral wrap, and an axial seal element on the axial end surface of said second spiral wrap in sliding, sealing relationship with said first end plate, said seal element terminating short of the inner end of said second spiral wrap so as not to contact said fluid passage means, the improvement wherein said fluid passage means has a generally elongated cross-section with the longer dimension thereof extending generally parallel to the adjacent portion of said first spiral wrap, said seal element terminating closer to the inner end of said second spiral wrap than it would for a fluid passage means having a less elongated cross-section, whereby a more complete axial seal is effected, thereby improving the volumetric efficiency of the apparatus.

2. An apparatus according to claim 1 wherein said fluid passage means includes a bore which extends through said first end plate into the inner end portion of said first spiral wrap and opens as a channel through the inner wall surface of said first spiral wrap facing the center of said first spiral wrap.

3. An apparatus according to claim 2 wherein the inner wall surface of said first spiral wrap protrudes inwardly at the inner end portion thereof so that said inner end portion is thickened.

4. An apparatus according to claim 1 or 2 further comprising an involute anti-wear plate within said first spiral wrap adjacent said first end plate, said seal element contacting said involute plate, and said fluid passage means extending through said involute plate.

5. An apparatus according to claim 4 wherein said fluid passage means comprises a hole through said first end plate and a passage through said involute plate overlying said hole, said passage having said elongated cross-section and being smaller than said hole so that said involute plate blocks a portion of said hole.

6. An apparatus according to claim 5 wherein said fluid passage means further comprises a plug in said hole shaped to fill up the blocked portion of said hole.

7. An apparatus according to claim 6 wherein said plug is affixed to the underside of said involute plate.

8. An apparatus according to claim 5 wherein said passage comprises a notch which opens toward the adjacent inner wall surface of said first spiral wrap.

9. In a scroll type fluid displacement apparatus including first and second scroll members having, respectively, first and second end plates and first and second spiral wraps extending from one side surface of said first and second end plates, said spiral wraps interfitting at an angular and radial offset to make a plurality of line contacts between the spiral curved surfaces of said spiral wraps and the opposed end plates thereby define a plurality of fluid pockets, driving means operatively connected to at least one of said scroll members to effect relative orbital motion of said scroll members while preventing relative rotation thereof thereby to cause said fluid pockets to move and change in volume, fluid passage means through said first end plate adjacent the center of said first spiral wrap, and an axial seal element on the axial end surface of said second spiral wrap in sliding, sealing relationship with said first end plate, said seal element terminating short of the inner end of said second spiral wrap so as not to contact said fluid passage means, the improvement wherein said fluid passage means comprises a bore which extends through said first end plate into the inner end portion of said first spiral wrap and opens as a channel through the inner wall surface of said first spiral wrap facing the center of said first spiral wrap, said seal element terminating closer to the inner end of said second spiral wrap than it would for a fluid passage means which extends closer to the center of said first spiral wrap, whereby a more complete axial seal is effected, thereby improving the volumetric efficiency of the apparatus.

10. An apparatus according to claim 9 wherein the inner wall surface of said first spiral wrap protrudes inwardly at the inner end portion thereof so that said inner end portion is thickened.

11. A scroll type fluid displacement apparatus comprising:

a housing having fluid inlet and outlet ports;

a first fixed scroll member fixedly disposed relative to said housing having a first end plate, a first spiral wrap extending from said end plate into the interior of said housing, and a hole for the passage of fluid near the center of said first end plate and adjacent the inner end portion of said first spiral wrap;

a second orbiting scroll member disposed within said housing having a second end plate and a second spiral wrap extending from said second end plate into the interior of said housing, said first and second spiral wraps interfitting at an angular and radial offset to make a plurality of line contacts between their spiral curved surfaces and axial contacts between the axial end surfaces of said spiral wraps and the opposed end plates thereby to define a plurality of fluid pockets;

driving means operatively coupled to said first scroll member to effect orbital motion thereof while preventing rotation thereof thereby to cause said fluid pockets to move and change in volume;

an involute anti-wear plate within said first spiral wrap adjacent said first end plate having a fluid passage overlying said hole, said fluid passage having an elongated cross-section and being smaller then said hole so that said involute plate blocks a portion of said hole, the longer dimension of said fluid passage extending generally parallel to the adjacent portion of said first spiral wrap; and an axial seal element on the axial end surface of said second spiral wrap in sliding, sealing relationship with said involute plate, said seal element terminating short of the inner end of said second spiral wrap so as not to contact said fluid passage means, but extending closer to said inner end that it would for a fluid passage having a less elongated cross-section, whereby a more complete axial seal is effected, thereby improving the volumetric efficiency of the apparatus.

12. An apparatus according to claim 11 wherein said hole comprises a bore which extends through said first end plate into the inner end portion of said first spiral wrap and opens as a channel through the inner wall surface of said first spiral wrap facing the center of said first spiral wrap.

13. An apparatus according to claim 12 wherein the inner wall surface of said first spiral wrap protrudes inwardly at the inner end portion thereof so that said inner end portion is thickened.

14. An apparatus according to claim 11 wherein said hole comprises a bore which extends through said first end plate, and a plug in said bore shaped to fill up the blocked portion of said bore.

15. An apparatus according to claim 14 wherein said plug is affixed to the underside of said involute plate.

16. An apparatus according to claim 11 or 12 wherein said passage comprises a notch which opens toward the adjacent inner wall surface of said first spiral wrap.

17. An apparatus according to claim 12 wherein said hole further comprises a plug in said bore shaped to fill up the blocked portion of said bore.

18. An apparatus according to claim 17 wherein said plug is affixed to the underside of said involute plate.

* * * * *